US011203965B2

(12) United States Patent
Obenaus

(10) Patent No.: US 11,203,965 B2
(45) Date of Patent: Dec. 21, 2021

(54) EXHAUST GAS AFTERTREATMENT SYSTEM

(71) Applicant: AVL LIST GMBH, Graz (AT)

(72) Inventor: Thomas Obenaus, Fernitz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 16/768,646

(22) PCT Filed: Dec. 3, 2018

(86) PCT No.: PCT/AT2018/060281

§ 371 (c)(1),
(2) Date: May 29, 2020

(87) PCT Pub. No.: WO2019/104364

PCT Pub. Date: Jun. 6, 2019

(65) Prior Publication Data

US 2021/0172366 A1 Jun. 10, 2021

(30) Foreign Application Priority Data

Dec. 1, 2017 (AT) ..... A 50992/2017
Nov. 19, 2018 (WO) ..... PCT/AT2018/060272

(51) Int. Cl.
*F01N 3/00* (2006.01)
*F01N 13/00* (2010.01)
*F01N 3/24* (2006.01)

(52) U.S. Cl.
CPC ..... *F01N 13/0097* (2014.06); *F01N 3/24* (2013.01); *F01N 2470/18* (2013.01); *F01N 2610/02* (2013.01)

(58) Field of Classification Search
CPC .... F01N 13/0097; F01N 3/24; F01N 2470/18; F01N 13/009; F01N 13/017
USPC ..... 60/286
See application file for complete search history.

(56) References Cited

U.S. PATENT DOCUMENTS 2,946,651 A * 7/1960 Houdry ..... B01D 53/944 423/212
3,935,705 A * 2/1976 Hergoualch ..... F01N 3/2882 60/302
4,386,497 A * 6/1983 Takagi ..... F01N 3/0211 55/DIG. 30
5,410,876 A * 5/1995 Simko ..... F01N 3/2053 60/288
6,212,885 B1 4/2001 Hirota et al.
6,314,722 B1 * 11/2001 Matros ..... F01N 3/0233 60/274

(Continued)

FOREIGN PATENT DOCUMENTS

DE 202016103189 U1 6/2016

*Primary Examiner* — Jason D Shanske
(74) *Attorney, Agent, or Firm* — Dykema Gossett PLLC

(57) ABSTRACT

An exhaust gas aftertreatment system for an internal combustion engine is disclosed. In one embodiment, the system has a first aftertreatment element including a first inlet region and a first outlet region, and a second aftertreatment element including a second inlet region and a second outlet region The first outlet region is connected to the second inlet region via at least one connection section, and the at least one connection section extends outside the first aftertreatment element. At least parts of the first inlet region and of the second inlet region are arranged in a common distributor housing.

12 Claims, 6 Drawing Sheets

(56) References Cited

U.S. PATENT DOCUMENTS

| | | | | |
|---|---|---|---|---|
| 6,655,133 | B2 * | 12/2003 | Mikami | F01N 3/035 60/296 |
| 7,900,443 | B2 * | 3/2011 | Stieglbauer | F01N 3/021 60/297 |
| 10,605,142 | B2 * | 3/2020 | Grosch | F01N 3/2892 |
| 2002/0152746 | A1 | 10/2002 | Mikami et al. | |
| 2008/0245060 | A1 * | 10/2008 | Stieglbauer | F01N 13/0097 60/311 |
| 2011/0047994 | A1 * | 3/2011 | Kato | F01N 3/2066 60/301 |

* cited by examiner

EXHAUST GAS AFTERTREATMENT SYSTEM

CROSS-REFERENCE TO RELATED APPLICATIONS

This application is a national stage filing based upon International application No. PCT/AT2018/060281, filed 3 Dec. 2018, which claims the benefit of priority to Austria application No. A 50992/2017, filed 1 Dec. 2017. This application also claims priority to International Application No. PCT/AT2018/060272, filed 19 Nov. 2018.

BACKGROUND

The invention relates to an exhaust gas aftertreatment system for an internal combustion engine, comprising at least a first aftertreatment element and a second aftertreatment element, wherein the first aftertreatment element has a first inlet region and a first outlet region, and the second aftertreatment element has a second inlet region and a second outlet region, and the first outlet region is connected to the second inlet region via at least one connection section, and the connection section extends outside of the first aftertreatment element.

Exhaust gas aftertreatment systems for the aftertreatment of exhaust gases from internal combustion engines can now be found in almost all modern motor vehicles. Usually, various aftertreatment elements, such as primarily particulate filters or catalytic converters, are connected one behind the other, and optionally between the individual units an additive is added to the exhaust gas and is mixed therewith. This takes place by injection into a mixing section. Aftertreatment elements of this type usually comprise a substrate body which has catalytic properties or which chemically changes the gas in some other way, and a casing which surrounds the substrate body. The casing may optionally also delimit an inlet region or outlet region, which serve mainly for supplying and discharging the gas.

US 2015/0037219 A1 describes exhaust gas aftertreatment systems comprising two catalytic converters which are connected via a mixing section. An inlet region of the first catalytic converter and an inlet region of the second catalytic converter are directly adjacent to one another. The mixing section is routed either only through the first catalytic converter or also through the second catalytic converter. One disadvantage is that, as a result, at least one catalytic converter must be annular in shape, which reduces the cross-sectional area through which the flow can pass. To compensate for this, the necessary cross-section of the cylindrical system must be enlarged. In addition, the routing of the mixing section in the interior is the manufacture complicated and therefore expensive.

EP 2 868 882 A1 discloses exhaust gas aftertreatment systems which likewise comprise two catalytic converters, wherein a mixing section is routed outside of the catalytic converters. The catalytic converters are arranged next to one another horizontally such that the inlet regions thereof are far apart, so that there is enough space for the mixing section. Although this has the advantage of being easier to produce, such systems nevertheless take up a large amount of space since, particularly in the areas of the inlet regions and outlet regions, a lot of space is lost due to the disadvantageous arrangement. Another disadvantage is that the catalytic converters are thermally decoupled, as a result of which the warm-up time is relatively long. In addition, the two catalytic converters must be attached independently of one another. The separate design also has a disadvantageous effect on the component rigidity and thus on the durability.

SUMMARY OF THE INVENTION

The problem addressed by the invention is thus that of providing an exhaust gas aftertreatment system which is easy to manufacture and which can be made as compact as possible.

This problem is solved according to the invention in that at least parts of the first inlet region and of the second inlet region are arranged in a common distributor housing.

By routing the connection section outside of the first aftertreatment element, a very stable design can be achieved if at least parts of the first inlet region and of the second inlet region are arranged in a common distributor housing. At the same time, such a system is easy to manufacture since there is no need to provide a connection section in the interior of the aftertreatment elements. However, the external routing of the connection section is not detrimental in terms of the space requirement, since space is saved by arranging the inlet regions adjacent to one another. At the same time, a direct heat transfer from the first inlet region to the second inlet region can occur without the connection section additionally being heated. This speeds up the warm-up process of the exhaust gas aftertreatment system.

Preferably, the aftertreatment elements are arranged such that the adjacent inlet regions are located between the aftertreatment elements, and the first outlet region is arranged at a point remote from the second aftertreatment element and the second outlet region is arranged at a point remote from the first aftertreatment element. In such an embodiment, the connection section is ideally routed outside of the housing along the first aftertreatment element, for example parallel to the latter, resulting in a particularly slim structure that is easy to manufacture.

In the context of the invention, the distributor housing is to be understood to mean in particular a housing by or in which a first and a second intake region are distributed in each case from a region having a smaller cross-section to a region having a larger cross-section. With particular preference, the distributor housing is in particular directly connected, for example in a materially bonded manner, to the first aftertreatment element and/or to the second aftertreatment element. It may also be advantageous if the distributor housing and the first and second aftertreatment element are formed and/or produced in one piece. In any case, it is advantageous if the distributor housing directly adjoins the first and/or second aftertreatment element. A splitting of one flow into two or more flows in the distributor housing is in particular not provided. It is advantageous if the distributor housing is provided and designed exclusively for changing the cross-section of a region and/or diverting a flow.

It is advantageous if the first inlet region and the second inlet region are separated by at least one partition. The regions can thus be separated while being arranged directly adjacent to one another and thermally coupled. In addition, it may also be provided that the distributor housing with the partition is designed such that the first and the second aftertreatment element can be flowed through simultaneously via the respective inlet regions.

In one preferred embodiment, the distributor housing has a housing casing, in which the partition is inserted. This has the advantage that a space-saving structure which is more rigid and as stable as possible is found, which also enables a particularly good heat transfer between the inlet regions if the housing casing and partition structure is suitably selected. In addition, the shape and arrangement of the partitions can be freely selected, and the flow behaviour of the gas can be influenced thereby. Such embodiments are very easy to manufacture since first the housing casing is produced and then the partition can be installed. The housing casing is preferably directly connected to the aftertreatment elements.

If at least a first casing of the first aftertreatment element, a second casing of the second aftertreatment element, and the distributor housing are formed substantially in one piece, this has the advantage of an even simpler design. By way of example, once the one-piece component has been manufactured, the substrate bodies can be inserted therein and the connection section, preferably together with the first outlet region, can subsequently be attached, particularly preferably by welding. However, it may also be advisable to form even more parts of the exhaust gas aftertreatment system in one piece. For reasons of easier production, however, it may also be advantageous to form most of the exhaust gas aftertreatment system in one piece and subsequently to install any optionally provided partitions. In the context of the invention, the one-piece design is also to be understood to mean a materially bonded connection of the three housings.

Preferably, the distributor housing has a housing casing which has a substantially cylindrical shape. It may particularly preferably be provided that a first and second intake opening are arranged on the housing casing. With very particular preference, the intake openings are arranged opposite one another.

In one preferred, space-saving embodiment variant, the distributor housing has a first intake opening and a second intake opening, wherein at least one of the two is arranged radially on the housing casing. It may be provided that the radially arranged first or second intake opening is arranged offset with respect to the other intake opening. Accordingly, the distributor housing may also have a first intake opening and a second intake opening, wherein at least one of the two intake openings is arranged tangentially on the housing casing.

Preferably, the first intake opening and the second intake opening are arranged substantially diametrically on the housing casing. This facilitates the manufacture of the housing casing and a subsequent welding or other attachment of components adjoining the latter, such as for example the connection section or an exhaust gas intake pipe which supplies the exhaust gas to the exhaust gas aftertreatment system.

If at least one partition is provided, which is arranged between the first inlet region and the second inlet region, the exhaust gas flow, but also other properties of the exhaust gas aftertreatment system, such as for example the heat transfer capacity between the inlet regions, can be influenced by the shape and the precise arrangement thereof. Various embodiments are possible in principle; one advantageous embodiment of the partition has at least one through-opening. The first inlet region and the second inlet region are thus flow-connected, which enables a gas exchange between the two inlet regions. This may be advantageous since a short-circuit flow can thus occur, as a result of which the warm-up phase of the second aftertreatment element can be shortened. The shape and number of the through-openings can be selected differently.

If the through-opening can be closed by a flap, a flow connection of the first inlet region and the second inlet region can be prevented or brought about as required, and the size of the through-opening can be adjusted. In particular, if the position of the flap can be adjusted from outside, the position of the flap can be changed on the basis of the currently prevailing conditions, even during operation.

It is advantageous to provide at least two partitions which delimit at least one compensating space between the first capture inlet region and the second inlet region. This may have various advantages. On the one hand, this may be advantageous for optimizing the shape of the surfaces of the partitions that face toward the inlet regions. Since it may be advantageous to make the partitions thin, but the desired shapes or sizes of the first inlet region and of the second inlet region cannot be achieved by one partition alone, both desired shapes can be achieved by installing two partitions. On the other hand, the provision of multiple partitions can also be used to adjust the heat transfer characteristic between the first capture inlet region and the second inlet region. It may also be advantageous to provide through-openings in at least one partition in order to enable an at least partial ventilation of the compensating spaces or connections between the compensating spaces.

A particularly simple and effective embodiment provides at least one partition having—at least in part—a substantially planar profile. Fold regions may be provided in the edge regions for attaching the partition to the housing casing, but these have barely any influence on the flow properties and are therefore irrelevant. The plane in which the planar profile extends can be selected differently.

In one preferred embodiment variant, at least one partition has a curved profile in at least one flow direction—in particular in at least one of the main flow directions which are significantly influenced by the arrangement of the first and second inlet region. Here, a curved profile will be understood to mean a substantially undulating shape of the partition. In particular, the exhaust gas distribution over the cross-sections of the aftertreatment elements can thus be improved. For instance, a suitable curved shape may help to ensure that a sufficient supply of exhaust gas is achieved even to the parts of the aftertreatment elements that are otherwise undersupplied, for example because they are far from the intake openings. However, flow separations and eddy currents can also be specifically prevented or reduced thereby, depending on the design of the curved shape.

A similar effect can also be achieved if at least one partition has at least one bent edge. These have the advantage of being easy to manufacture and therefore being able to be implemented more cost-effectively.

One particularly advantageous, space-saving and slim embodiment provides that the first aftertreatment element and the second aftertreatment element are arranged coaxially one behind the other.

If the connection section is configured at least in part as a mixing section, the gas can be intensively mixed and thus homogenized between the first and second aftertreatment element. Particularly if the mixing section has an injection device, preferably for injecting urea, the gas may additionally be mixed with other substances, such as urea, in order to bring about desired chemical reactions such as the reduction of nitrogen oxides and ammonia. Alternatively, an injection device may also be arranged in the second outlet region, preferably just before the mixing section.

BRIEF DESCRIPTION OF THE DRAWINGS

The present invention will be explained in greater detail below on the basis of the embodiment variants shown in the non-limiting figures, in which.

DETAILED DESCRIPTION

Figure 1:
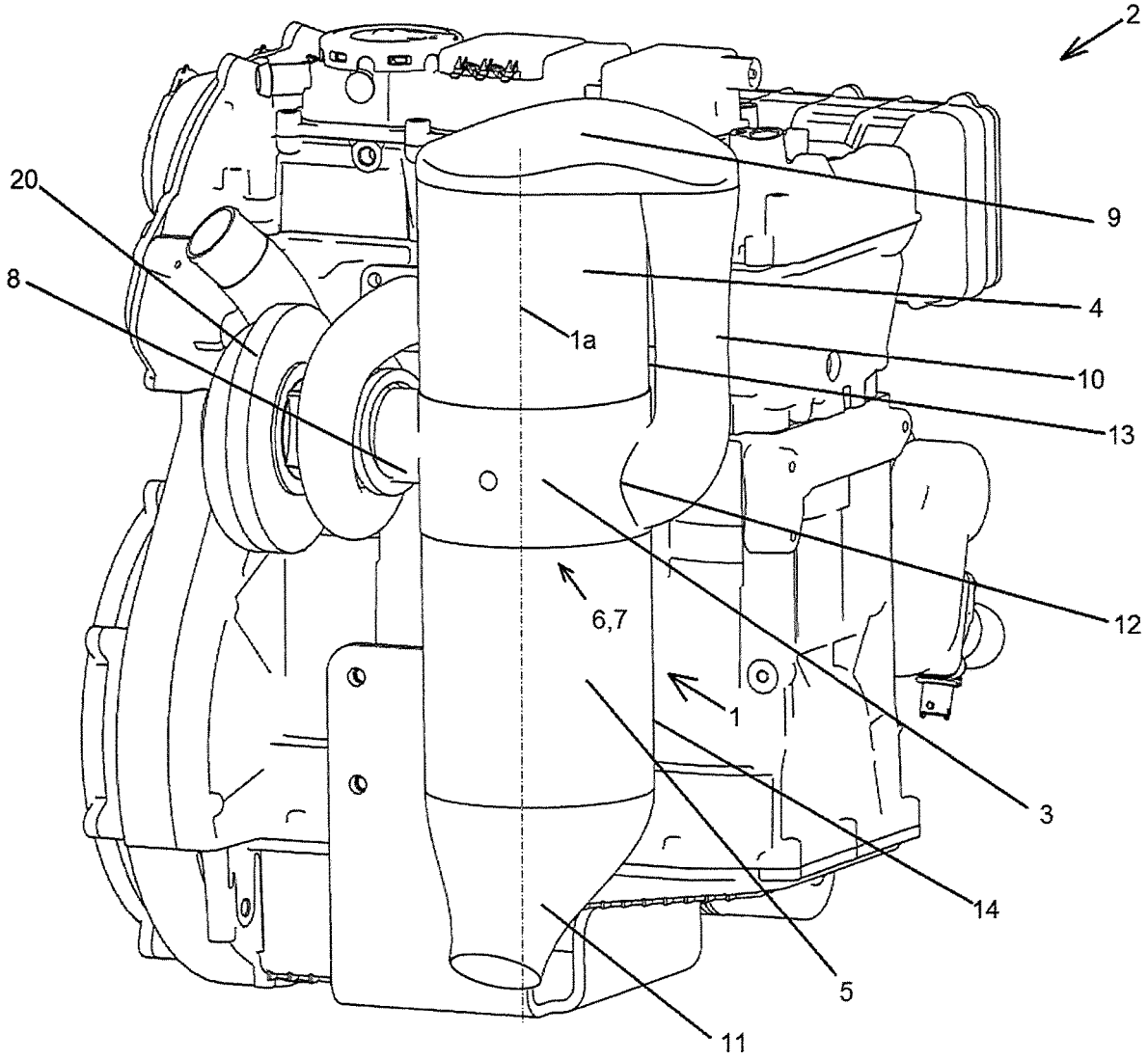
FIG. 1 shows, in an oblique view, an exhaust gas aftertreatment system according to the invention with an internal combustion engine in a first embodiment.

FIG. 1 shows an exhaust gas aftertreatment system 1 which is connected to an internal combustion engine 2. The exhaust gas aftertreatment system 1 comprises a first aftertreatment element 4 and a second aftertreatment element 5, wherein, in the example shown, these are arranged one above the other and vertically in relation to the intended operating position of the vehicle. Furthermore, they are arranged coaxially along a longitudinal axis 1*a*. Arranged between the first aftertreatment element 4 and the second aftertreatment element 5 are a first inlet region 6 and a second inlet region 7, wherein the latter are arranged in a distributor housing 3. The first inlet region 6 has a first intake opening 8, which is connected to the internal combustion engine 2 via a turbocharger 20. Via this connection, the first inlet region 6 is supplied with exhaust gas. During operation, the latter flows via the first inlet region 6 into the first aftertreatment element 4 and is routed via a first outlet region 9 into a connection section 10. Said connection section 10 is configured as a mixing section. There, gases or liquids may optionally be injected and may mix with the exhaust gas. Via a second intake opening 12, the exhaust gas can flow into the second inlet region 7 and onward through the second aftertreatment element 5. It is finally routed onward via the second outlet region 11 out of the exhaust gas aftertreatment system 1 and optionally to additional devices for treating the exhaust gas, to the exhaust pipe, or to other elements of the vehicle. A housing casing 24 of the distributor housing 3, the first intake opening 8, the second intake opening 12, a first casing 13 of the first aftertreatment element 4 and a second casing 14 of the second aftertreatment element 5 are formed in one piece and are part of a common housing. This is advantageous since a very high degree of rigidity can thus be achieved along the longitudinal extent of the exhaust gas aftertreatment system 1. In addition, the first aftertreatment element 4 and the second aftertreatment element 5 can thus be easily inserted into the one-piece component. Thereafter, the second outlet region 11 and the first outlet region 9 together with the connection section 10 can be attached by welding. As a result, an embodiment which is as compact as possible and at the same time stable is produced in a very simple manner. The housing casing 24 of the distributor housing 3 has a substantially cylindrical shape.

Figure 2:
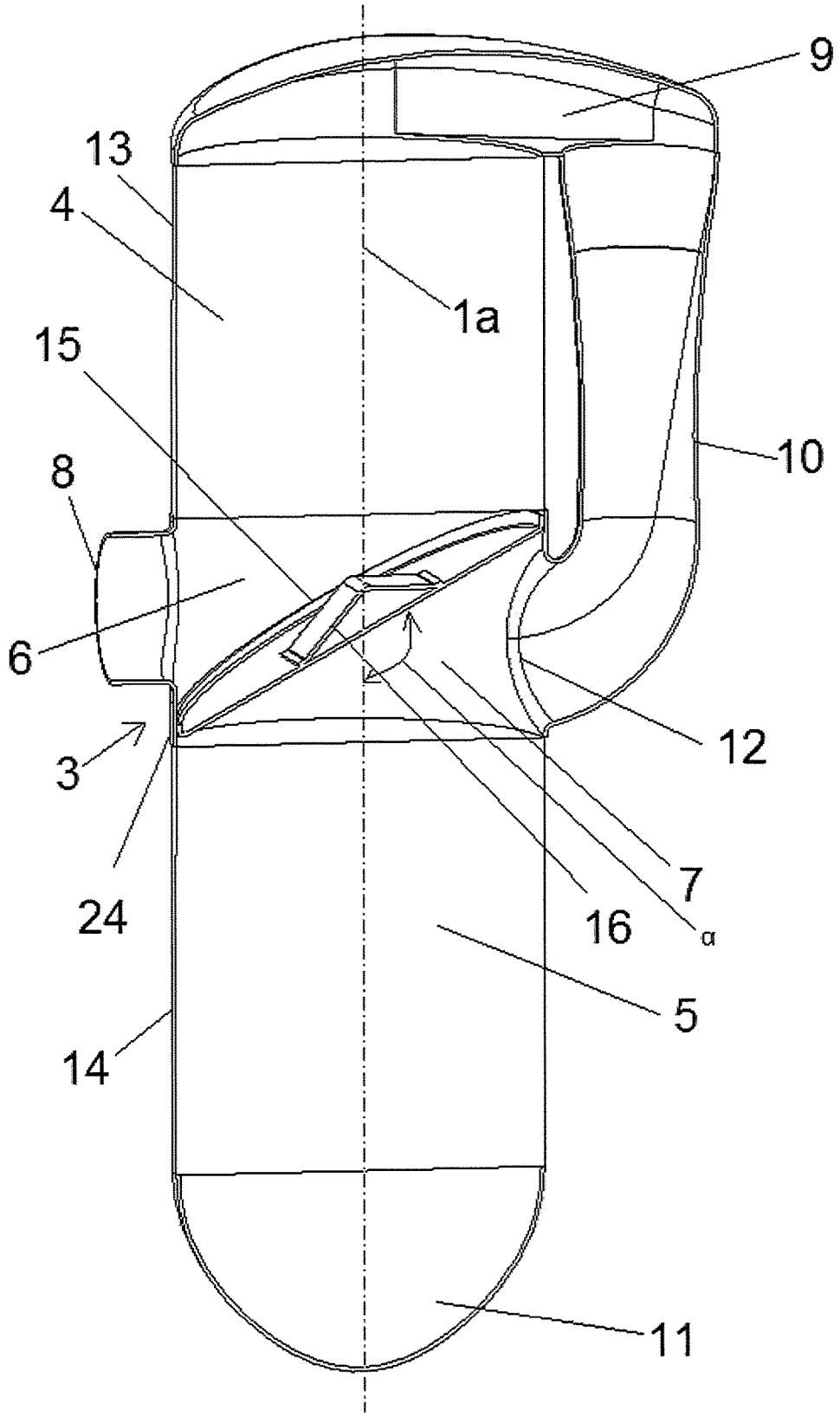
FIG. 2 shows, in a longitudinal section, an exhaust gas aftertreatment system according to the invention in a second embodiment.

FIG. 2 shows, in section, a further embodiment. The arrangement of the individual elements is similar, but the first casing 13 of the first aftertreatment element 4 and the second casing 14 of the second aftertreatment element 5 are not formed in one piece with the distributor housing 3. The parts are individually welded together, as a result of which it is more easily possible to insert a partition 13 into a housing casing 24 prior to assembly. The partition 15, which is inclined at an angle $\alpha$ of, for example, between approximately 15° and 75°, in particular 30°, relative to the longitudinal axis 1*a* of the exhaust gas aftertreatment system, divides the interior of the distributor housing 3 into two parts of substantially equal size, namely the first inlet region 6 and the second inlet region 7. The partition is substantially planar along an inclined axis, apart from a folded edge for attachment to the housing casing 24 and a flow obstruction 16. Said flow obstruction 16 is arranged centrally and is directed toward the first inlet region 6, so that the flow of gas flowing through the first intake opening 8 into the first inlet region 6 is swirled by the flow obstruction 16. As a result, the areas of the first aftertreatment element 4 close to the connection section 10 are better supplied with exhaust gas, and a better pressure distribution is made possible.

Figure 3:
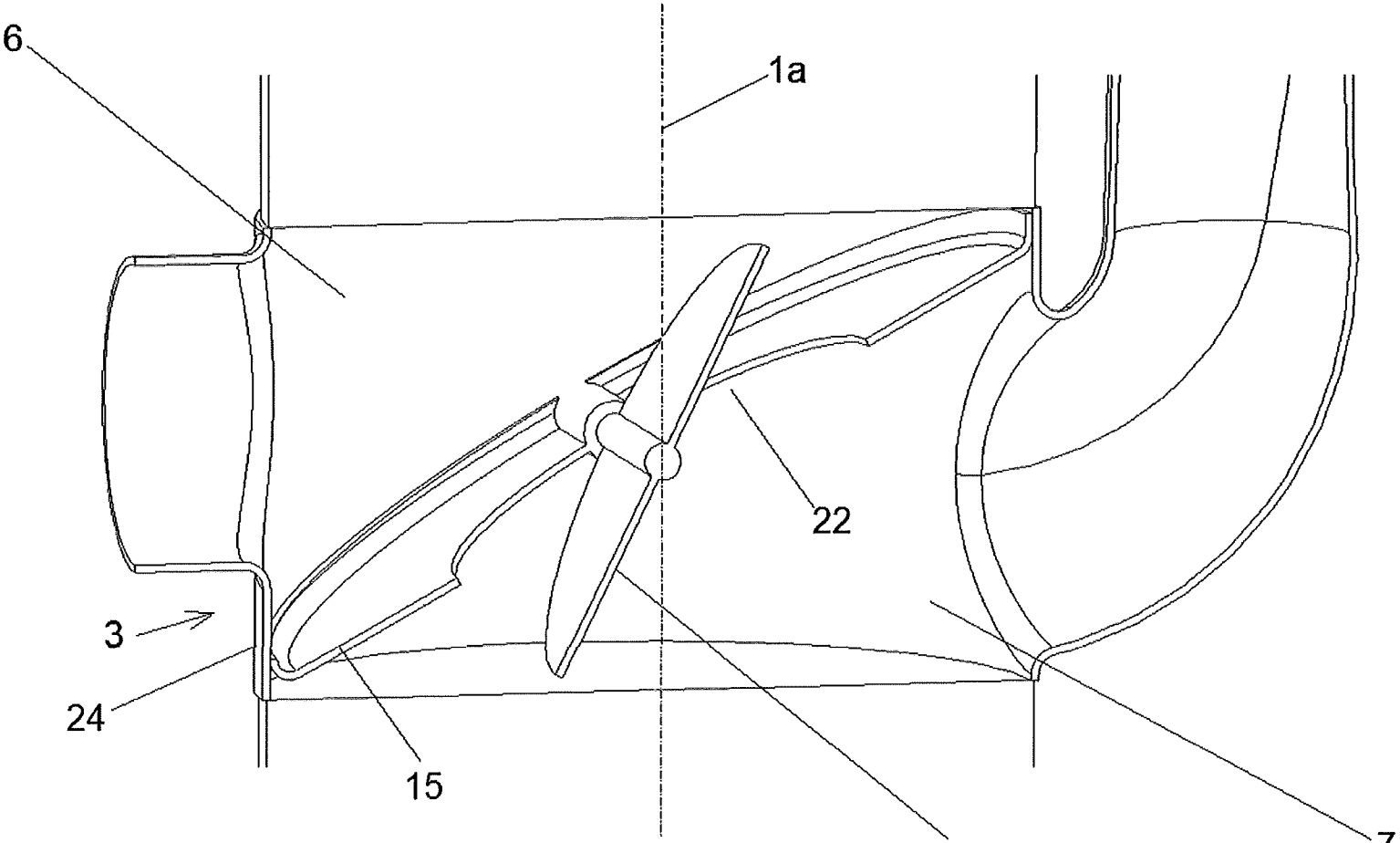
FIG. 3 shows, in a longitudinal section, a detail of an exhaust gas aftertreatment system according to the invention in a third embodiment.

FIG. 3 shows a detail of a third embodiment, namely the area of the first inlet region 6 and second inlet region 7. The partition 15 has, arranged centrally, a through-opening 22 with a pivotably mounted flap 17, which establishes a connection between the first inlet region 6 and the second inlet region 7. Said flap 17 can be brought into different opening angles or can be closed. As a result, the proportion of gas flowing in through the intake opening 8 and flowing directly into the second inlet region 7 can be adjusted, for example as a function of particular operating parameters, such as the temperature, or particular operating phases. Alternatively, it may also be advantageous to provide openings which cannot be closed by flaps.

Figure 4:
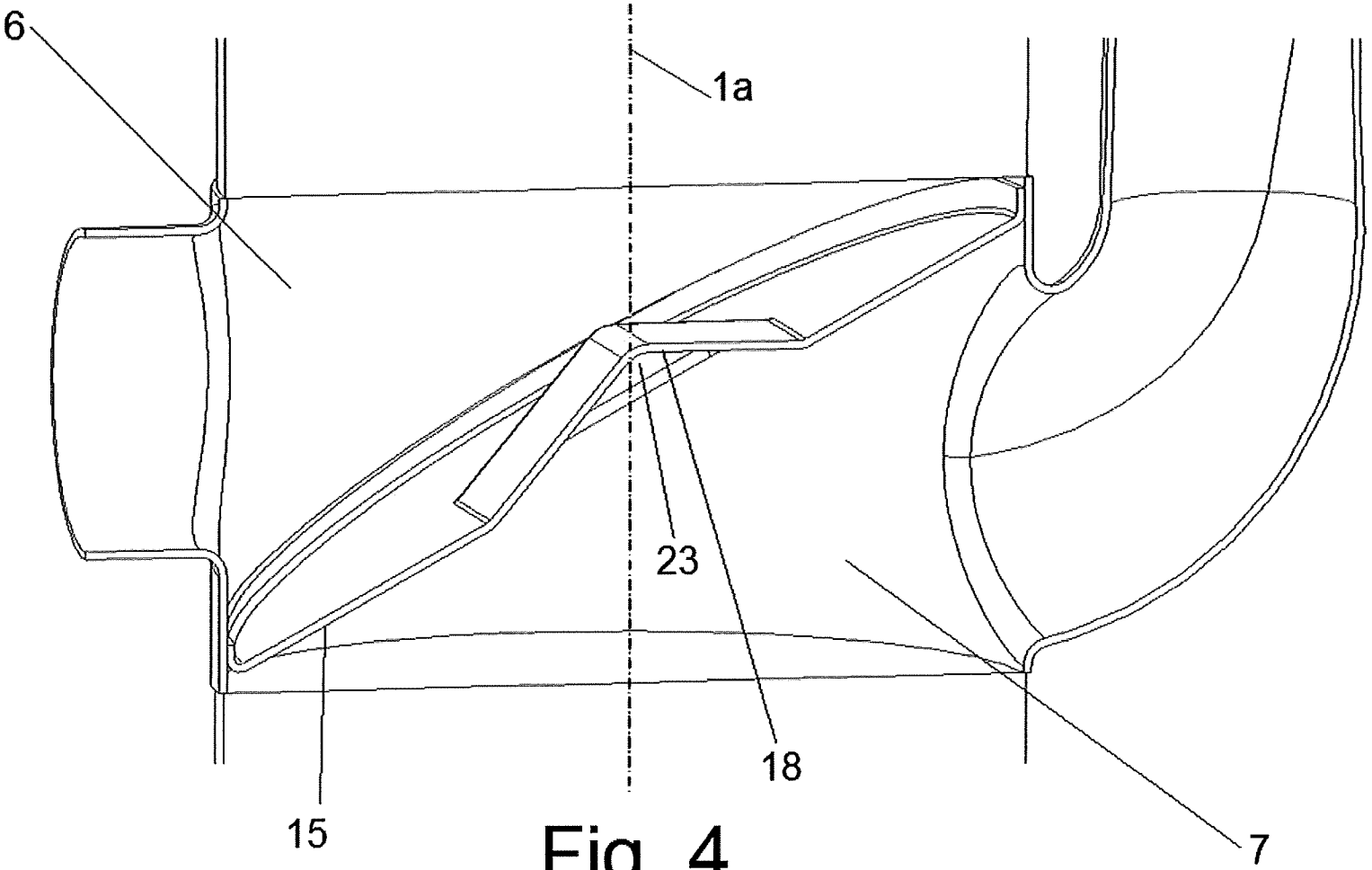
FIG. 4 shows, in a longitudinal section, a detail of an exhaust gas aftertreatment system according to the invention in a fourth embodiment.

FIG. 4 shows a detail of a fourth embodiment, wherein the partition 15 has a projection 18 which is formed in one piece with the partition 15. The projection 18 has side walls 23 at the sides, as a result of which there are no openings establishing a direct connection between the first inlet region 6 and the second inlet region 7. In this advantageous embodiment, the exhaust gas flowing into the first aftertreatment element 6 is swirled, mixed and slowed by the projection 18, as a result of which a good flow is achieved even through areas of the first aftertreatment element 6 that are otherwise poorly supplied with gas. At the same time, the resulting indentation of the partition 15 on the side facing toward the second inlet region 7 can achieve similar effects.

Figure 5:
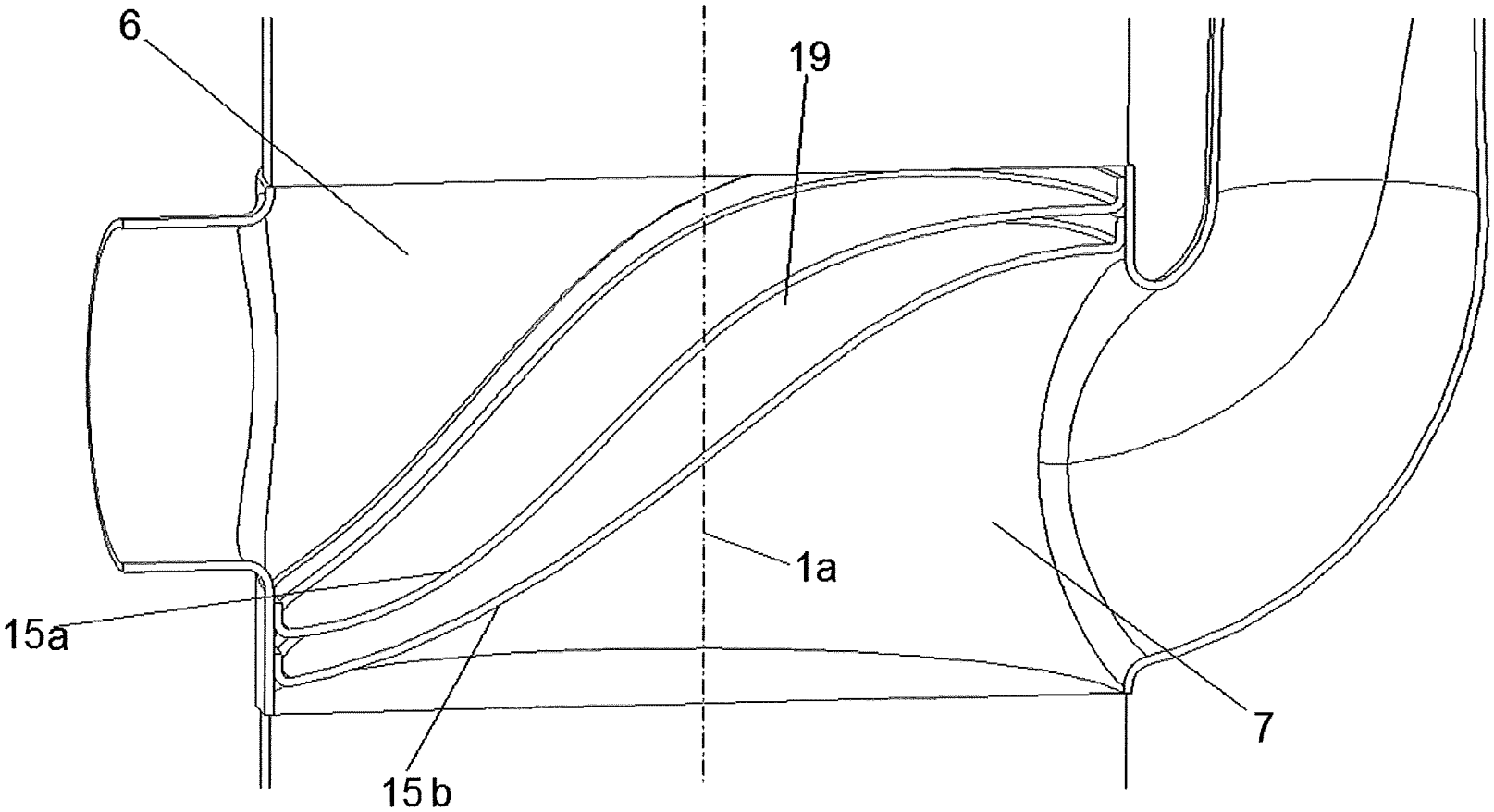
FIG. 5 shows, in a longitudinal section, a detail of an exhaust gas aftertreatment system according to the invention in a fifth embodiment.

FIG. 5 shows a detail of a fifth embodiment, wherein two partitions 15*a*, 15*b* are provided. Both have an identical curved shape and delimit a compensating space 19 therebetween. As a result, both partitions 15*a*, 15*b* can be made thin, as a result of which they can be easily produced and machined despite the complex shape. On the one hand, the compensating space 19 changes the heat transfers between the first inlet region 6 and the second inlet region 7. On the other hand, by selecting the size of the compensating space 19, the first inlet region 6 and the second inlet region 7 can also be reduced in size.

Figure 6:
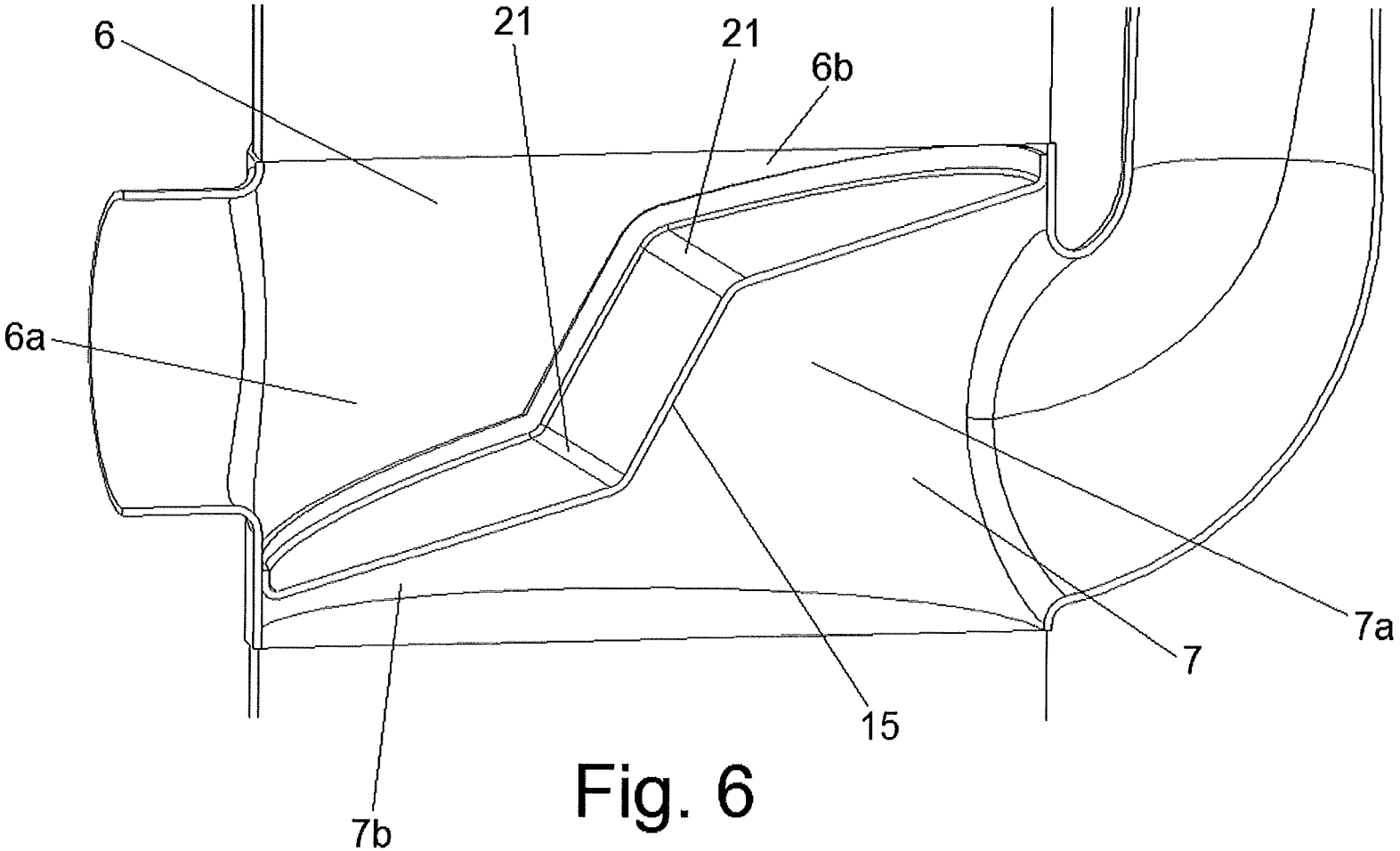
FIG. 6 shows, in a longitudinal section, a detail of an exhaust gas aftertreatment system according to the invention in a sixth embodiment.

FIG. 6 shows, in section, a detail of a sixth embodiment variant, in which the partition 15 has two bent edges 21. In the embodiment shown, each bent edge 21 extends along an axis from one point of contact with the edge of the partition 15 to the other. This creates a relatively large first main space 6*a* and a relatively small first secondary space 6*b* in the first inlet region 6 close to the first intake opening 8, and a relatively large second main space 7*a* and a relatively small second secondary space 7*b* in the second inlet region 7 close to the second intake opening 12. This likewise leads to a swirling and a change in the pressure distribution over the cross-section of the first aftertreatment element 6 and second aftertreatment element 7, but at the same time this embodiment is very easy to produce, which is advantageous.

The invention claimed is:

1. An exhaust gas aftertreatment system for an internal combustion engine, the exhaust gas aftertreatment system comprising:

a first aftertreatment element including a first inlet region and a first outlet region; and a second aftertreatment element including a second inlet region and a second outlet region; and at east one partition separating the first and second inlet regions; and at least one through-opening fluidly extending between the first and second inlet regions and through the at least one partition, the at least one through-opening configured to be selectively closed by a flap; and a connection section fluidly coupling the first outlet region to the second inlet region, and the connection section extends outside of the first aftertreatment element.

2. The exhaust gas aftertreatment system of claim 1, wherein at least parts of the first inlet region and of the second inlet region are arranged in a common distributor housing.

3. The exhaust gas aftertreatment system of claim 2, characterized in that the common distributor housing includes a housing casing in which the at least one partition is inserted.

4. The exhaust gas aftertreatment system of claim 2, the first aftertreatment element including at least a first casing the second aftertreatment element including a second casing, and wherein the common distributor housing, first casing and second casing are formed in one piece.

5. The exhaust gas aftertreatment system of claim 3, characterized in that the common distributor housing includes a first intake opening and a second intake opening, and at least one of the first and second intake openings is arranged radially on the housing casing.

6. The exhaust gas aftertreatment system of claim 5, characterized in that the first intake opening and the second intake opening are arranged diametrically on the housing casing.

7. The exhaust gas aftertreatment system of claim 1, wherein the least one partition includes at least two partitions which delimit at least one compensating space between the first inlet region and the second inlet region.

8. The exhaust gas aftertreatment system of claim 1, characterized in that the at least one partition has—at least in part—a substantially planar profile.

9. The exhaust gas aftertreatment system of claim 1, characterized in that the at least one partition has a curved profile at least in a flow direction.

10. The exhaust gas aftertreatment system of claim 1, characterized in that the at least one partition has at least one bent edge.

11. The exhaust gas aftertreatment system of claim 1, characterized in that the first aftertreatment element and the second aftertreatment element are configured and arranged coaxially one behind the other.

12. The exhaust gas aftertreatment system of claim 1, characterized in that the connection section is configured and arranged at least in part to mix the exhaust gas.

* * * * *